US010239340B2

(12) United States Patent
Pape

(10) Patent No.: US 10,239,340 B2
(45) Date of Patent: Mar. 26, 2019

(54) MANUAL SUPPORT FOR A MULTI-PAGE DOCUMENT

(71) Applicant: Donald Robert Pape, Alexandria, VA (US)

(72) Inventor: Donald Robert Pape, Alexandria, VA (US)

( * ) Notice: Subject to any disclaimer, the term of this patent is extended or adjusted under 35 U.S.C. 154(b) by 0 days.

(21) Appl. No.: 15/731,684

(22) Filed: Jul. 17, 2017

(65) Prior Publication Data

US 2019/0016171 A1 Jan. 17, 2019

(51) Int. Cl.

| | |
|---|---|
| ***B42F 1/00*** | (2006.01) |
| ***B42F 3/00*** | (2006.01) |
| ***B42F 1/08*** | (2006.01) |
| ***B31F 5/00*** | (2006.01) |
| *G09F 3/16* | (2006.01) |
| *B42D 12/00* | (2006.01) |

(52) U.S. Cl.

CPC ..... *B42F 1/003* (2013.01); *B31F 5/00* (2013.01); *B42F 1/08* (2013.01); *B42F 3/00* (2013.01); *B42D 12/00* (2013.01); *G09F 3/16* (2013.01)

(58) Field of Classification Search

CPC ... B42F 1/003; B42F 1/08; G09F 3/16; A47B 23/06; B42D 9/00

USPC ..... 248/302, 303, 112, 249, 218, 462, 446, 248/447, 460, 464, 451, 452, 453; 281/45, 42, 51; 24/546; 40/650

See application file for complete search history.

(56) References Cited

U.S. PATENT DOCUMENTS

| | | | | |
|---|---|---|---|---|
| 430,813 | A | 6/1870 | Strippel | |
| 261,976 | A * | 8/1882 | Adams | |
| 274,719 | A * | 3/1883 | Carlock et al. | B42D 9/00 281/42 |
| 316,499 | A * | 4/1885 | Thomas | B42F 1/08 24/67.9 |
| 330,402 | A * | 11/1885 | Hunsaker | B42D 9/00 281/42 |
| 415,588 | A * | 11/1889 | Swartz | A47B 23/042 248/451 |
| 563,056 | A | 6/1896 | Parker | |
| 953,409 | A * | 3/1910 | Connies | |
| 1,196,715 | A * | 8/1916 | Noll | B42D 9/00 281/42 |
| 1,204,373 | A * | 11/1916 | Mieden | B42F 1/08 24/552 |
| 1,266,885 | A * | 5/1918 | Toll | B42D 9/00 281/32 |

(Continued)

FOREIGN PATENT DOCUMENTS

DE 202014008712 U1 * 11/2015 ..... B42D 9/00

*Primary Examiner* — Kimberly T Wood

(74) *Attorney, Agent, or Firm* — Palmer C. DeMeo; Palmer Patent Consultants, LLC

(57) ABSTRACT

A hand held device for manually holding a multi-page document with a U-shaped element having a ring-shaped extension at one end of an elongated leg and a shorter leg parallelly spaced therefrom by a right angle extension at the opposite end of the elongated leg whereby the shorter leg is inserted between the pages along the inner side of the multi-page document's binding and the longer leg is positioned along the outer side of the multi-page document's binding such that a person can support the multi-page document with one hand by inserting, in part, a preselected finger of one hand through the ring-shaped extension.

16 Claims, 2 Drawing Sheets

(56) References Cited

U.S. PATENT DOCUMENTS

| | | | | | |
|---|---|---|---|---|---|
| 1,385,991 | A * | 8/1921 | French | B42D 3/145 | 116/238 |
| 1,415,631 | A * | 5/1922 | Grimm | B42D 9/004 | 116/237 |
| 2,278,143 | A * | 3/1942 | Matthews | B42D 9/00 | 281/42 |
| 2,837,802 | A * | 6/1958 | Genco | B42D 3/14 | 24/336 |
| 2,898,920 | A | 7/1959 | Oehler | | |
| 3,513,806 | A * | 5/1970 | Ferrick | B42D 3/145 | 116/237 |
| 4,235,457 | A * | 11/1980 | Brewer | B42D 9/00 | 24/67.3 |
| 4,335,903 | A * | 6/1982 | Collins | B42F 1/02 | 281/42 |
| 4,735,438 | A * | 4/1988 | Demarest, Jr. | B42D 9/00 | 24/67.3 |
| 4,932,680 | A * | 6/1990 | Rivera | B42D 9/00 | 24/546 |
| 6,089,609 | A * | 7/2000 | Denley | B42D 9/00 | 116/234 |
| 6,170,877 | B1 | 1/2001 | Zurn | | |
| 6,186,464 | B1 * | 2/2001 | Whitman | B42D 9/00 | 248/444 |
| 6,357,796 | B1 * | 3/2002 | Halstead | B42D 9/00 | 281/42 |
| 7,237,756 | B2 | 7/2007 | Isenberg | | |

* cited by examiner

MANUAL SUPPORT FOR A MULTI-PAGE DOCUMENT

CROSS REFERENCE TO RELATED APPLICATIONS

This application claims the benefit of and priority from U.S. Provisional Patent Application Ser. No. 62/494,024 filed on Jul. 25, 2016 and entitled MANUAL SUPPORT FOR A MULTI-PAGE DOCUMENT.

BACKGROUND OF THE INVENTION

1. Field of the Invention

The present invention relates to a manual support for a folder, notebook, binder or book and especially for a music score.

2. Description of the Related Art

Generally, there is a problem in supporting documents such as binders, folders, or music scores for lecturers or choir members in the absence of stands or lecterns. In such a situation it becomes necessary for a person such as a lecturer or choir member to hold the document in his or her hand while lecturing or singing. Therefore, attempts have been made to provide a hand-held supporting device for a lecturer or choir member to hold the document in his or her hand. One such device is disclosed in U.S. Pat. No. 7,237,756 which teaches the use of a removable, attachable manual support. However, the device disclosed in this patent is quite awkward to use because of its several component parts which require a manipulation of two hands by the lecturer or choir member in order to attach it to the document. The manipulation of this device is not only awkward but also time consuming and needs some dexterity on the part of the lecturer or choir member in order to attach this device to the document desired to be supported. Another hand-held prior art device for manually holding or supporting a document such as a book is disclosed in U.S. Pat. No. 6,170,877. Although this prior art device in one disclosed embodiment is simple in structure because of its unitary solid structure it is quite bulky and in another disclosed embodiment it would appear to cause a strain on the person's thumb because of the springiness of the metal wire structure.

SUMMARY OF THE INVENTION

It is an object of this invention to provide a hand-held device for supporting a multi-page document that is easily applied to the document. It is another object of this invention to provide a hand-held device for supporting a multi-page document that is simple in structure, sturdy and light weight. It is a further object of this invention to use this hand-held device for supporting binders, folders or books. It is also an object of this hand-held device to use this device for supporting multi-paged notes for a lecturer or teacher in the absence of a lectern. In particular, it is an object of this hand-held device to use this device in supporting a music score for a choir member in the absence of a music stand. This hand-held device is simple in structure in the form of a U-shape with one leg longer than the other. The longer leg of this hand-held device has a top end with a ring-shaped extension extending therefrom and the shorter leg has a bottom end joined to the bottom end of the longer leg by a lateral connector. The hand-held device of this invention is made of metal for sturdiness and light weight in mass, preferably brass, but other well known, light weight and malleable metals may also be used. This U-shaped hand-held device is applied to the lower end of the multi-page document along the spine or binding of the paged document with the shorter leg of the device inserted between opposite open pages along the spine or binding of the multi-page document while the longer leg of the device contacts the outer side of the multi-page document along the spine or binding of the multi-page document. (The meaning of a multi-page document in this application is meant any document that has several pages centrally supported by a spine or binding and which multi-page document can be generally manually supported by a person.) In practice, for example, the choir member or lecturer embraces the outer side of an open multi-page document with his/her hand while inserting his/her selected finger through the ring-shaped extension at the top end of the longer leg of the U-shaped, hand-held device thus supporting the multi-page document. The selected finger is generally determined by the preferred or desired balance of the multi-page document in the hand of the user. For example, for a longer multi-page document, the ring or little finger of the user may be selected. The multi-page document should be balanced in the hand of the user. Maximum stability of a multi-page document in the hand of the user of the U-shaped hand-held device of this invention is simple to determine. If the multi-page document dips away from the user while being held in the hand of the user then the middle or index finger is generally selected for insertion into the ring shape extension of the U-shaped hand-held device of this invention. If the multi-page document tips toward the user while being held in the hand of the user then the ring or possibly the little finger of the user is generally selected for insertion into the ring shape extension of the of the U-shaped hand-held device of this invention. Either the left or right hand of the person can be used with the U-shaped, hand-held device of this invention.

Other objects and advantages in the use of the hand-held supporting device of this invention will become apparent upon reading the following description of which the attached drawings form a part.

DESCRIPTION OF THE PREFERRED EMBODIMENT

Figure 1:
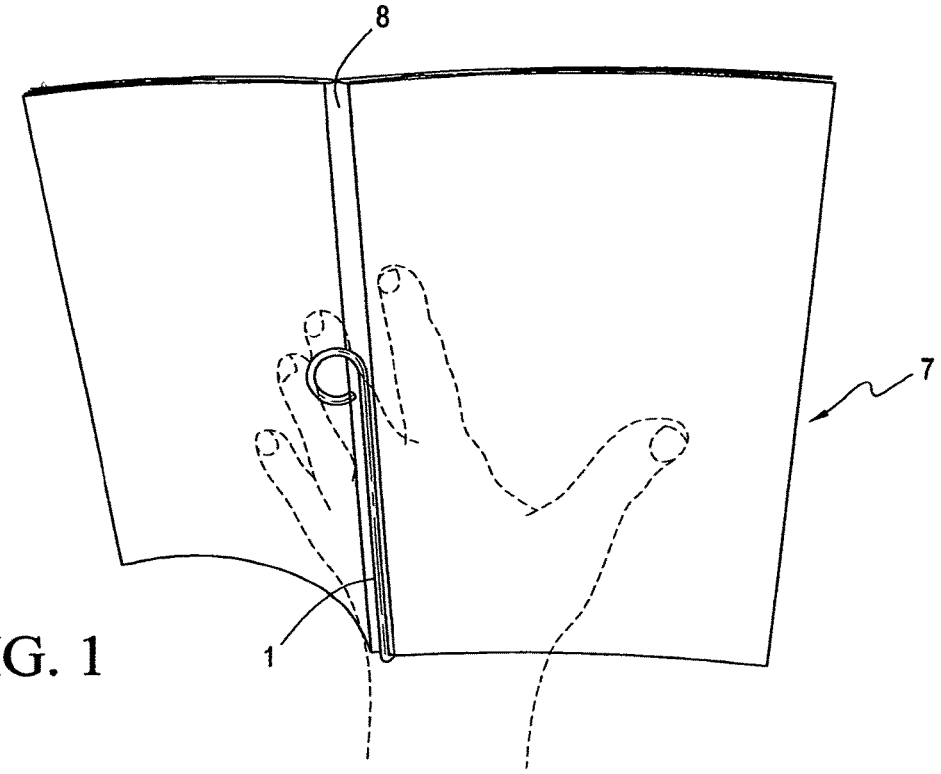
FIG. 1 is a perspective view showing an application of the hand-held device of this invention supporting a multi-page document by the left or right hand of a user.

As shown in FIGS. 3-6, the hand-held supporting device 1 is U-shaped with an elongated, straight, wire shaped long leg 2 having a ring-shaped extension 3 at its top end and an elongated, straight, flat shaped shorter leg 4 spaced therefrom with a connecting section 5 between the two elongated legs 2 and 4. The supporting device 1 is preferably made from brass but it can also be made from other well-known sturdy and malleable materials. Although the long leg 2 of the hand-held supporting device 1 is wire shaped the shorter leg 4 is flat and wider than the long leg 2 in order to provide rotational stability around the spine of the paged document. The ring-shaped extension 3 of the supporting device 1 has an opening large enough in diameter to accommodate the insertion of the forefront of a selected finger of most persons (which will be explained hereinafter), for example, approximately ⅝ inch in inner diameter. The ring-shaped extension 3 encircles an angle of approximately 270 degrees leaving its free end spaced from the vertically extending long leg 2. However, the free end of the ring-shaped extension 3 could also extend up to the straight, wire shaped long leg 2. The length of the long leg 2 of the hand-held supporting device 1 is approximately 6 inches and the length of the shorter leg 4 is approximately 3 and ¾ inches. The shorter leg 4 of the hand-held supporting device 1 has a width of approximately ¼ inch and a thickness of approximately 3/32 inch. Although the tip at the upper end of the shorter leg 4 may be straight edged it is preferably rounded in order to prevent it from tearing into the pages when the shorter leg 4 is inserted between the opposite open pages of the multi-page document 7. The spacing between the long leg 2 and the shorter leg 4 is approximately 5/16 of an inch. The diameter of the long leg 2 and the ring-shaped extension 3 is approximately ⅛ inch. The bottom end of the long leg 2 has a right angle extension 5 extending in the opposite direction from the direction of the ring-shaped extension 3. The right angle extension 5 has a groove 6 at the tip thereof to accommodate the insertion of the bottom end of the shorter leg 4. The groove 6 has a depth of approximately ¼ inch equaling the width of the shorter leg 4 and has a width of approximately 1/16 inch or fractionally larger to accommodate the insertion of the lower end of the shorter leg 4. The shorter leg 4 is preferably silver soldered within the groove 6 although other old and well known soldering means may also be used. The ring-shaped extension 3 and the right angle extension 5 of the long leg 2 are formed by cold bending the rod around a form to achieve the desired shape, a technique well known in the art and need not be explained further here. The shorter leg 4 may be made by techniques well known in the art or be obtained from stock material.

As indicated earlier, the hand-held supporting device 1 of this invention can be used by either a right handed or left handed person. Although these dimensions for the hand-held supporting device 1 of this invention are designed to accommodate a multi-page document 7 of approximately 7 inches by 10 and ½ inches as, for example, a music score. It would be obvious to one having ordinary skill in the art that these dimensions can be varied to accommodate other multi-page documents of different sizes and/or other sized fingers.

Referring to FIG. 1. In order to use the hand-held supporting device 1 of this invention a person merely inserts the U-shaped hand-held device 1 between the inside lower end of the multi-page document 7 along the spine or binding 8 and the outer side of the multi-page document 7 along the spine or binding 8 of the multi-page document 7. Subsequently, the person grasps the multi-page document 7 with his/her left or right hand, as the case may be, while simultaneously inserting his/her selected finger through the ring-shaped extension 3 of the hand-held supporting device 1 of this invention.

Figure 2:
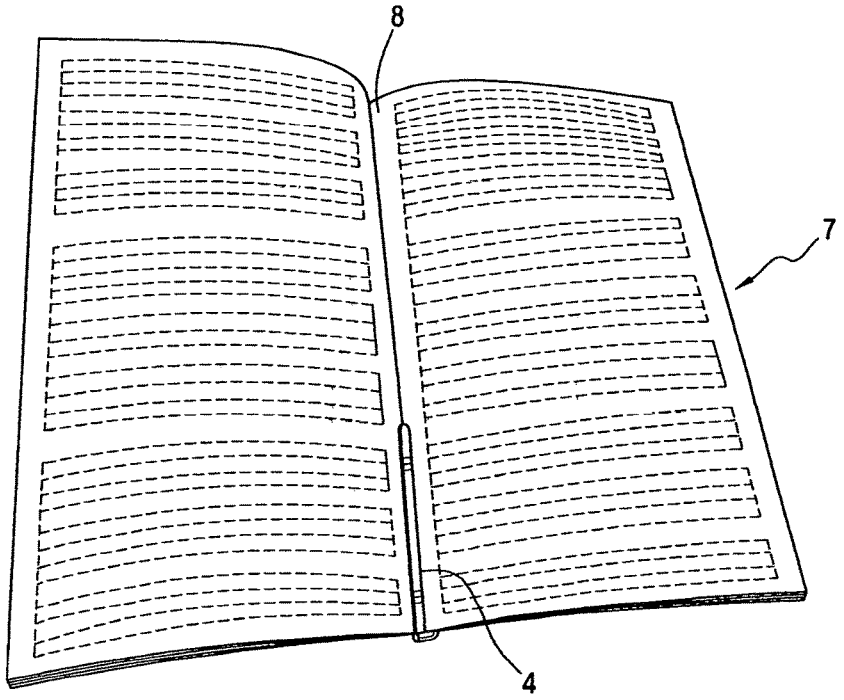
FIG. 2 is a perspective view showing the shorter leg of the hand-held device inserted between opposite open pages of the multi-page document shown in FIG. 1.
Figure 3:
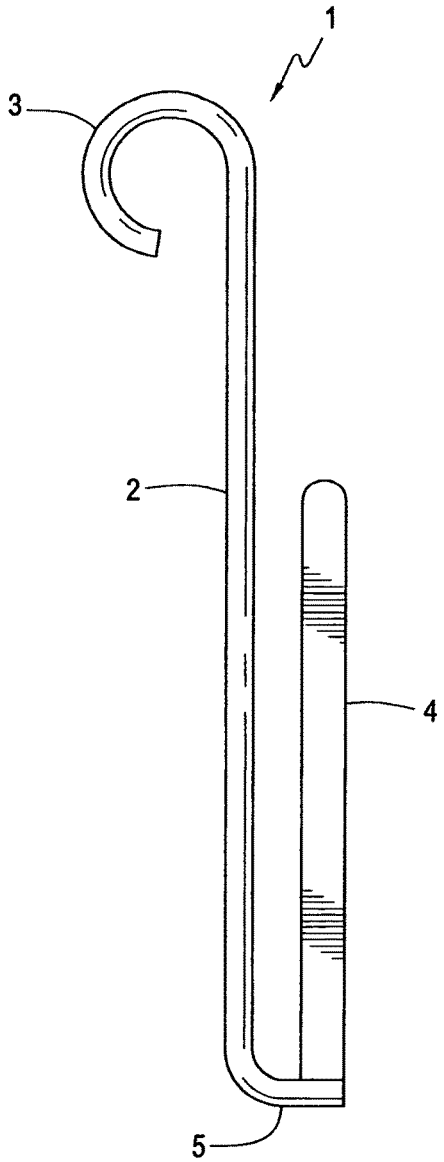
FIG. 3 is a side elevational view of the U-shaped hand-held device of this invention.
Figure 4:
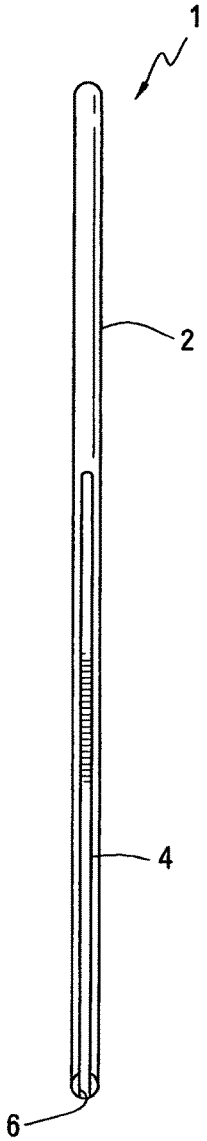
FIG. 4 is a front elevational view of the hand-held device shown in FIG. 3.
Figure 5:
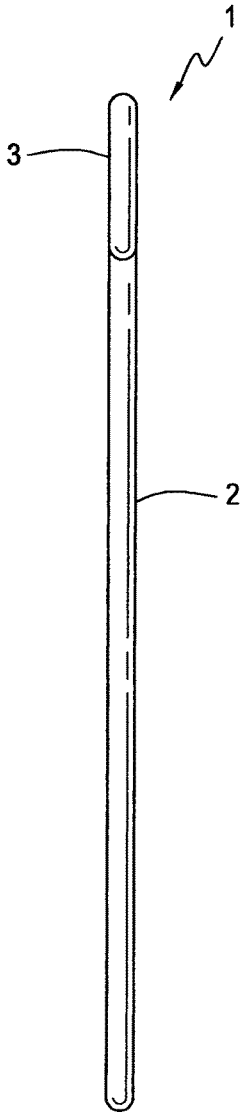
FIG. 5 is rear elevational view of the hand-held device shown in FIG. 3.
Figure 6:
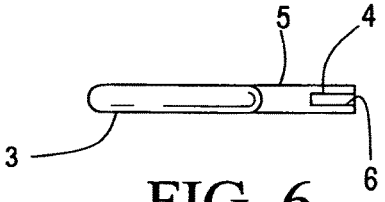
FIG. 6 is a top plan view of the hand-held device shown in FIG. 3.

Referring now to FIG. 2. FIG. 2 shows a front view of the open multi-page document 7 such as a music score with the shorter leg 4 of the U-shaped supporting device 1 inserted between the open pages of the multi-page document 7 along the spine or binding 8 of the multi-page document 7. In this process, the shorter leg 4 of the supporting device 1 is inserted between two opposite open pages of the multi-page document 7 one or both of which page or pages the reader desires to read while supporting the multi-page document 7 in his/her hand with the hand-held supporting device 1 of this invention.

Modifications of this invention will be readily apparent to those skilled in the art and it is intended that the invention be not limited by the embodiments disclosed herein but that the scope of the invention be defined by the appended claims.

What is claimed:

1. A hand held device for manually holding in a person's hand an open multi-page document with a central spine or binding, said hand held device comprising a substantially U-shaped element wherein said U-shaped element has an, elongated, straight, wire shaped leg, said elongated, wire shaped leg having an upper end and a lower end, said upper end of said elongated, wire shaped leg having a ring shaped extension, said lower end of said elongated, wire shaped leg having a right angle short extension, said U-shaped element having a leg shorter than said elongated, wire shaped leg, said shorter leg being parallelly spaced from said elongated, wire shaped leg at a predetermined distance, said right angle short extension having a free end and said shorter leg being attached to said free end of said right angle short extension such that said shorter leg is parallelly spaced from said elongated, wire shaped leg, wherein said shorter leg is flat, wherein said shorter leg has a predetermined thickness and said elongated, wire shaped leg has a predetermined diameter such that said predetermined thickness of said shorter leg is less than said predetermined diameter of said elongated, wire shaped leg and wherein said free end of said right angle short extension has a groove therein for inserting and securing a bottom end of said shorter leg.

2. A hand held device as recited in claim 1 wherein said bottom end of said shorter leg is secured in said groove by soldering.

3. A hand held device as recited in claim 2 wherein said shorter leg is secured in said groove by silver soldering.

4. A hand held device as recited in claim 3 wherein said shorter leg has a predetermined length and said elongated, wire shaped leg has a predetermined length, said predetermined length of said shorter leg being approximately one half to three quarters of said predetermined length of said elongated, wire shaped leg.

5. A hand held device as recited in claim 4 wherein said U-shaped element is made from metal.

6. A hand held device as recited in claim 1 wherein said ring shaped extension has an opening sized to accommodate a selected finger of said person's hand and wherein said person's hand is a left hand.

7. A hand held device as recited in claim 1 wherein said ring shaped extension has an opening sized to accommodate a selected finger of said person's hand and wherein said person's hand is a right hand.

8. A hand held device for manually holding in a person's hand an open multi-page document with a central spine or binding, said hand held device comprising a substantially U-shaped multi-sectioned element wherein said U-shaped element has a single, elongated, straight, wire shaped leg, said elongated, wire shaped leg having an upper end and a lower end, said upper end of said elongated, wire shaped leg having a ring shaped extension, said lower end of said elongated, wire shaped leg having a right angle short extension, said U-shaped element having a unitary straight leg shorter than said elongated, wire shaped leg, said unitary straight shorter leg having an upper free end and a lower end, said unitary straight shorter leg being parallelly spaced from said elongated, wire shaped leg at a predetermined distance, said right angle short extension having a free end and said lower end of said unitary straight shorter leg being attached to said free end of said right angle short extension such that said unitary straight shorter leg is parallelly spaced from said elongated, wire shaped leg, wherein said unitary straight shorter leg is flat.

9. A hand held device as recited in claim 8 wherein said unitary straight shorter leg has a predetermined thickness and said single elongated, wire shaped leg has a predetermined diameter wherein said predetermined thickness of said unitary straight shorter leg is less than said predetermined diameter of said single elongated, wire shaped leg.

10. A hand held device as recited in claim 9 wherein said free end of said right angle short extension has a groove therein for inserting and securing said lower end of said unitary straight shorter leg.

11. A hand held device as recited in claim 10 wherein said bottom end of said unitary straight shorter leg is secured in said groove by soldering.

12. A hand held device as recited in claim 11 wherein said bottom end of said unitary straight shorter leg is secured in said groove by silver soldering.

13. A hand held device as recited in claim 8 wherein said unitary straight shorter leg has a predetermined length and said single elongated wire shaped leg has a predetermined length, said predetermined length of said unitary straight shorter leg being approximately one half to three quarters of said predetermined length of said single elongated wire shaped kg.

14. A hand held device as recited in claim 8 wherein said U-shaped element is made from metal.

15. A hand held device as recited in claim 8 wherein said ring shaped extension has an opening sized to accommodate a selected finger of said person's hand and wherein said person's hand is a left hand.

16. A hand held device as recited in claim 8 wherein said ring shaped extension has an opening sized to accommodate a selected finger of said person's hand and wherein said person's hand is a right hand.

* * * * *